US005701963A

United States Patent [19]

McCormick et al.

[11] Patent Number: 5,701,963

[45] Date of Patent: Dec. 30, 1997

[54] CONTINUOUS INJECTION OF AN INERT GAS THROUGH A DRILL RIG FOR DRILLING INTO POTENTIALLY HAZARDOUS AREAS

[75] Inventors: Steve H. McCormick; William R. Pigott, both of Idaho Falls, Id.

[73] Assignee: The United States of America as represented by the United States Department of Energy, Washington, D.C.

[21] Appl. No.: 594,967

[22] Filed: Jan. 31, 1996

[51] Int. Cl.[6] ..... E21B 21/00; E21B 10/44

[52] U.S. Cl. ..... 175/215; 175/394

[58] Field of Search ..... 175/71, 215, 207, 175/21, 50, 69, 394

[56] References Cited

U.S. PATENT DOCUMENTS

| | | | |
|---|---|---|---|
| 3,596,720 | 8/1971 | Elenburg | 175/69 |
| 3,774,701 | 11/1973 | Weaver | 175/17 |
| 3,870,237 | 3/1975 | Aldrich | 241/1 |
| 3,885,629 | 5/1975 | Erb | 175/17 X |
| 4,351,400 | 9/1982 | Faulkner | 175/69 |
| 5,337,838 | 8/1994 | Sorensen | 175/59 |
| 5,388,650 | 2/1995 | Michael | 175/71 |

*Primary Examiner*—Frank Tsay

*Attorney, Agent, or Firm*—Robert J. Fisher; Mark P. Dvorscak; William R. Moser

[57] ABSTRACT

A drill rig for drilling in potentially hazardous areas includes a drill having conventional features such as a frame, a gear motor, gear box, and a drive. A hollow rotating shaft projects through the drive and frame. An auger, connected to the shaft is provided with a multiplicity of holes. An inert gas is supplied to the hollow shaft and directed from the rotating shaft to the holes in the auger. The inert gas flows down the hollow shaft, and then down the hollow auger and out through the holes in the bottom of the auger into the potentially hazardous area.

3 Claims, 3 Drawing Sheets

CONTINUOUS INJECTION OF AN INERT GAS THROUGH A DRILL RIG FOR DRILLING INTO POTENTIALLY HAZARDOUS AREAS

CONTRACTUAL ORIGIN OF THE INVENTION

The U.S. Government has rights in this invention pursuant to Contract No. DE-AC07-76ID01570 between the Department of Energy and EG&G Idaho, Inc.

BACKGROUND OF THE INVENTION

This invention relates to a safe way to drill in waste landfills where potential hazards may exist. More particularly, the invention provides a method and apparatus for drilling in a waste landfill where the presence of methane gas may creme explosive and extremely hazardous atmospheres.

Waste landfills are formed by filling a land area with successive layers of solid waste and earth or soil. Decomposition of a landfill occurs through natural biological action, involving precipitation and climate. A product of this decomposition is methane gas. Initially there is no methane production from a landfill. But through sequential stages of decomposition, significant generation of methane occurs. Methane gas came to attention because of its combustible nature. Methane is explosive in concentrations of 5 percent to 15 percent in air. The Lower Explosive Limit (LEL) is 5 percent methane. At concentrations above 15 percent, methane will support a flame. In addition to it combustion properties, methane has a propensity to migrate laterally.

On occasion, it is necessary for holes to be drilled in landfills. Many landfills are superfund sites and drilling is required to monitor for the presence of certain materials such as volatile organic compounds and gases. If elevated levels of methane are encountered during drilling, a spark could ignite the methane, causing a fire or explosion. This obviously creates a safety hazard to personnel, as well as property involved in the vicinity of the drilling. Recently, there have been instances where drilling rigs were burnt as the result of methane explosions in landfills.

It is therefore an object of the present invention to provide a means for safe drilling in landfills where the potential presence of methane could cause an explosion or fire.

Another object of the present invention is to provide a means for providing an inert atmosphere when drilling in potentially hazardous areas to prevent fires or explosions.

SUMMARY OF THE INVENTION

A drill rig for drilling in potentially hazardous areas can include a drill having conventional features such as a frame, a gear motor, gear box, and a drive. A hollow rotating shaft projects through the drive and frame. An auger, connected to the shaft is provided with a multiplicity of holes. A first supply provides an inert gas to the hollow shaft. A second supply directs the inert gas from the rotating shaft to the holes in the auger. The inert gas flows down the hollow shaft, and then down the hollow auger and out through the holes in the bottom of the auger.

In operation, a method for continuously injecting an inert gas from a drill rig into the drill zone of a potentially hazardous area can include directing an inert gas so that the gas flows down the rotating shaft of the drill rig. The inert gas is then directed from the shaft to hollow auger, and out into the potentially hazardous area through the holes in the auger. In this manner, the inert gas penetrates the area where the drilling occurs to prevent the ignition of gases that could cause a fire or an explosion.

BRIEF DESCRIPTION OF THE DRAWINGS

The above-mentioned and other features of the invention will become more apparent and be best understood, together with the description, by reference to the accompanying drawings, in which.

DETAILED DESCRIPTION OF THE INVENTION

Figure 1:
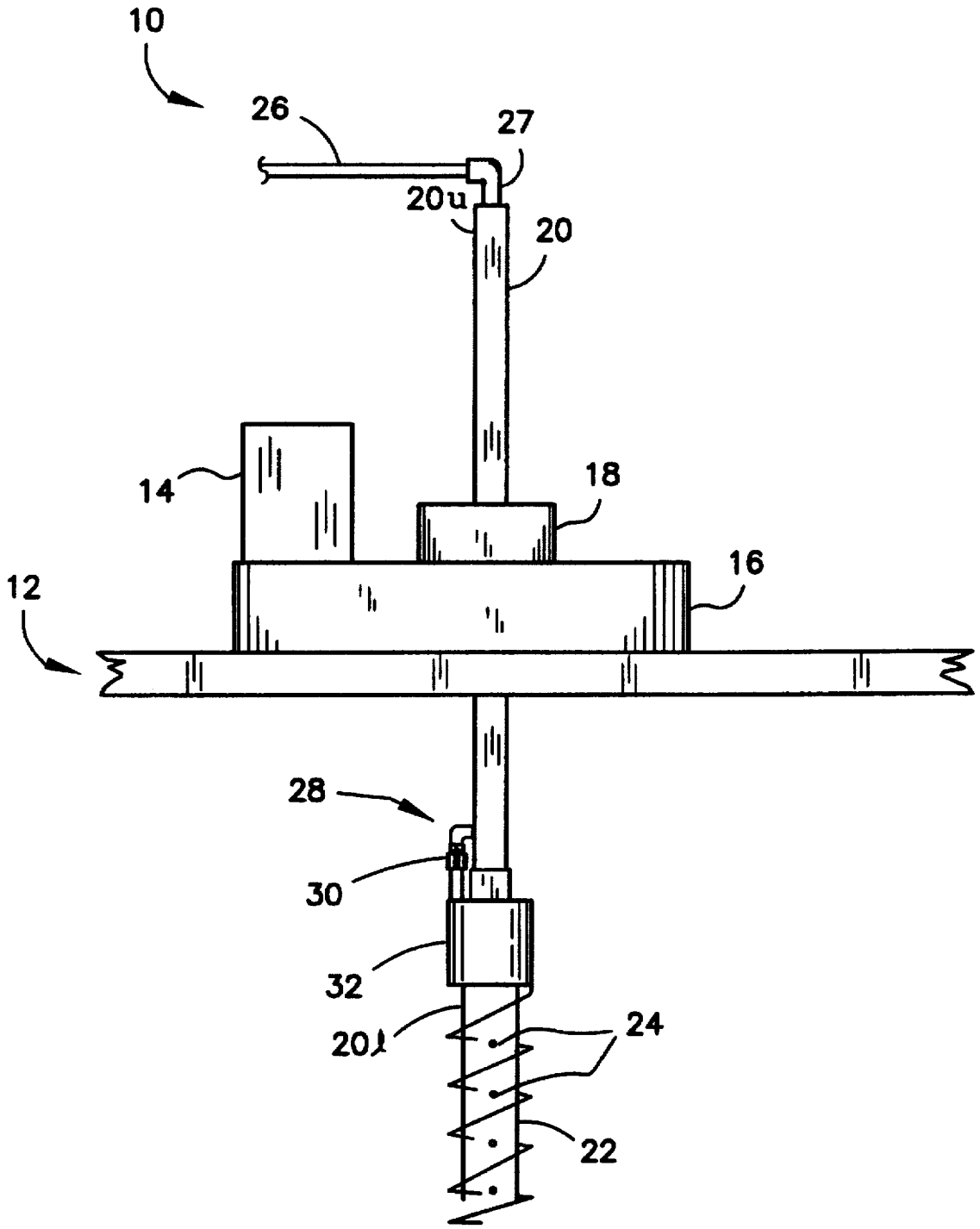
FIG. 1 shows a drill rig in accordance with the present invention modified to provide a continuous nitrogen purge.
Figure 2:
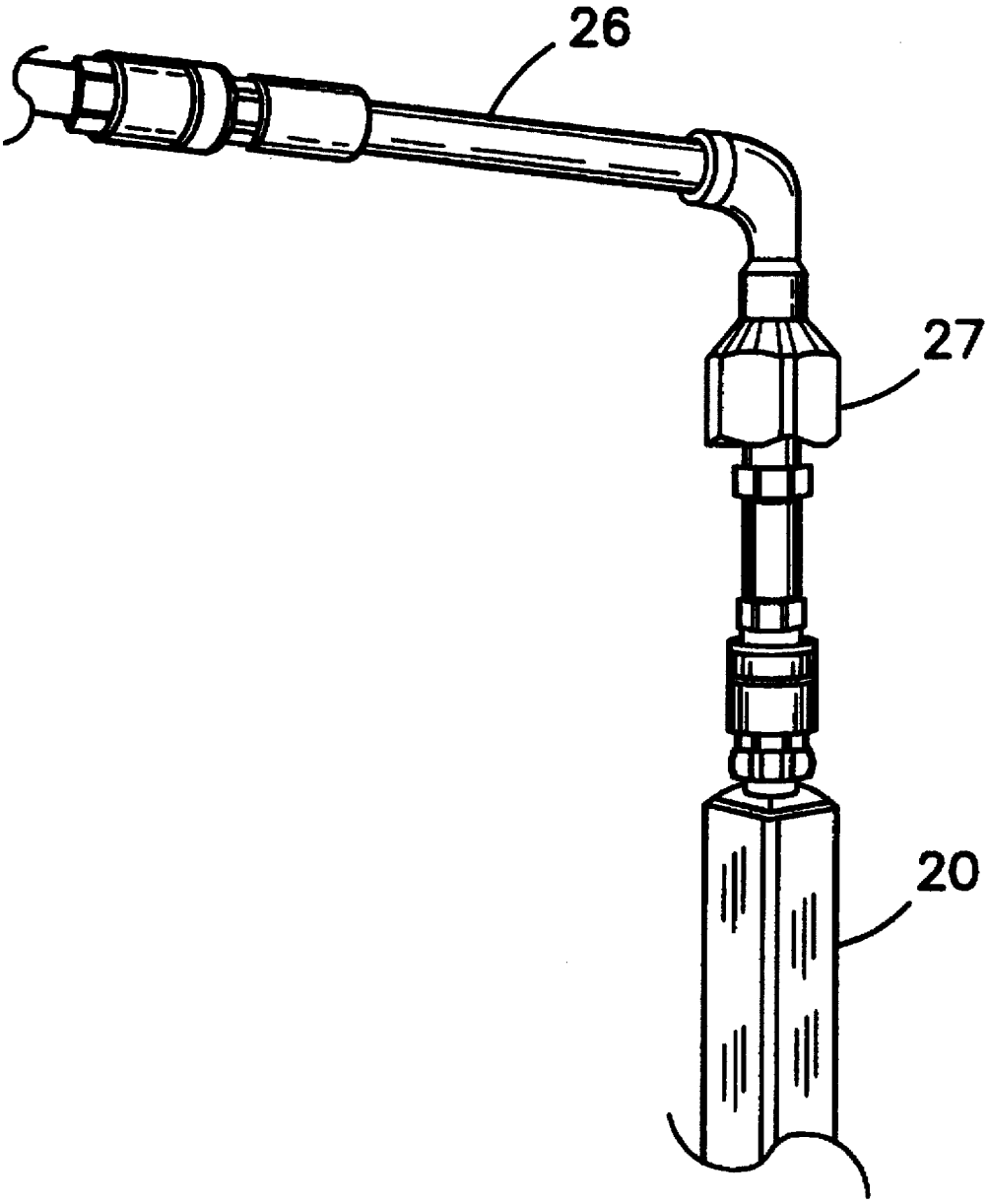
FIG. 2 shows a view of a rotating fitting attached to the drive shaft of the drill rig; and, FIG. 3 shows a view of the bottom fitting of the drill rig adapted for quick assembly and disassembly.
Figure 3:
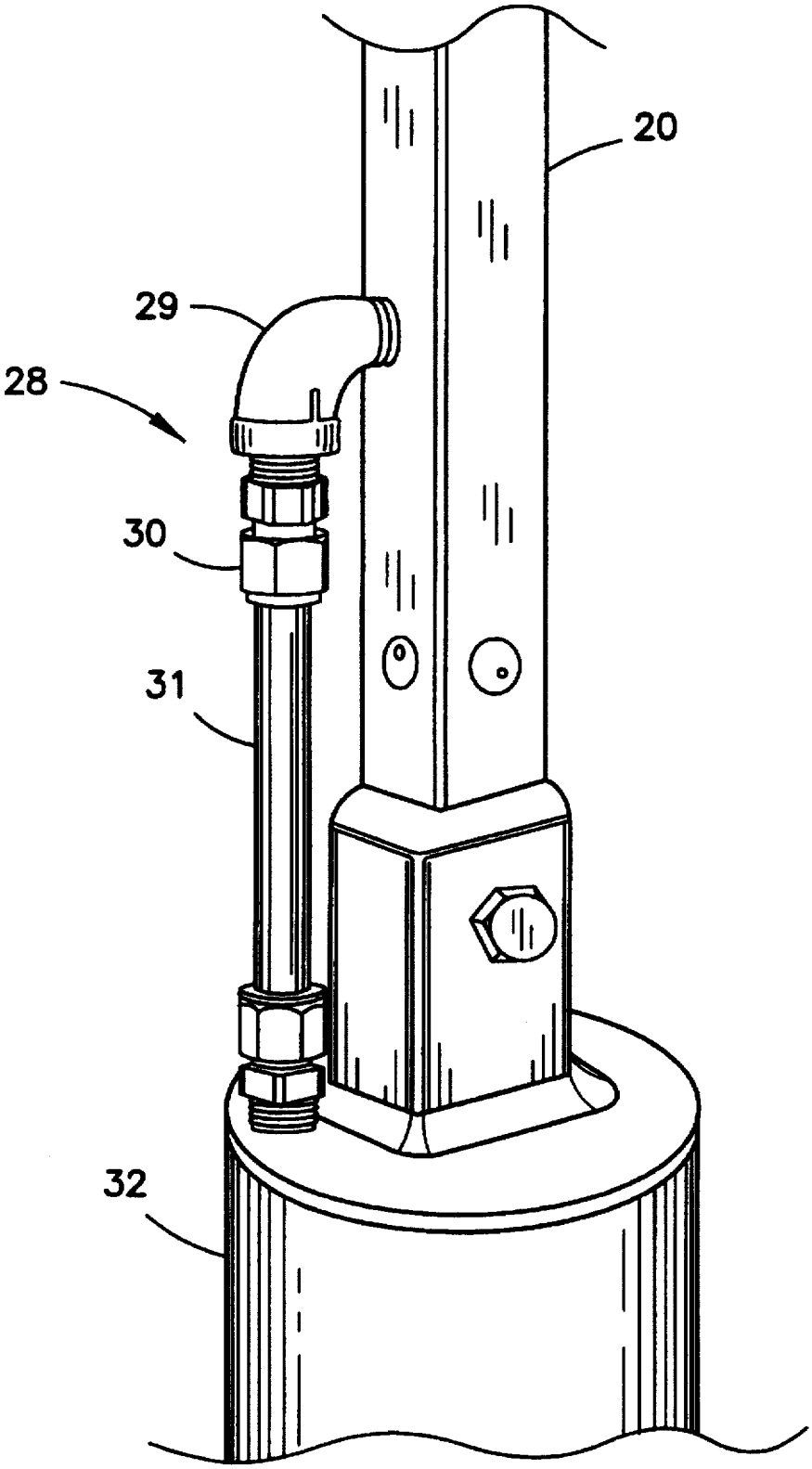

A drill rig 10 for drilling in potentially hazardous areas in accordance with the present invention is shown in FIG. 1. The drill rig includes a frame 12 on which a gear motor 14, gear box 16, and drive 18 are mounted. A hollow square rotating shaft 20, having an upper end 20u and a lower end 20l, projects through the drive and frame. An auger 22 is connected to the shaft at the lower end 20l. The auger 22 is provided with a multiplicity of holes 24. A first supply 26 at the upper end 20u of the rotating shaft supplies an inert gas to the hollow shaft 20. The supply 26 is a pipe connected to a rotating or swivel fitting 27 that in turn connects to the drive shaft 20. To prevent leakage of the gas, a seal can be placed in the fitting 27. A second supply 28 located at the lower end 20l of the shaft directs the inert gas from the rotating shaft to the holes 24 in the auger 22. The second supply 28 can include a pipe elbow and short section of pipe. This arrangement provides for supplying the gas to the hollow auger 22, as well as for allowing quick assembly and a quick disconnect of the auger.

The inert gas flows down the hollow shaft 20, and then down the hollow auger 22 and out through the holes 24 in the bottom of the auger.

In operation, a method for continuously injecting an inert gas from a drill rig 10 into the drill zone of a potentially hazardous area includes: directing an inert gas through the supply 26 and the fitting 27, so that the gas flows down the rotating shaft 20 of the drill rig 10. The inert gas is then directed from the shaft 20 to hollow auger 22, and out into the potentially hazardous area through the holes 24. In this manner, the inert gas penetrates the area where the drilling occurs. The inert gas in the drilling zone will prevent a spark from igniting gases that could cause a fire or an explosion. If there was a spark, there would not be enough oxygen present to cause a fire or an explosion.

This description of a preferred embodiment of a drill rig for drilling in potentially hazardous areas has been presented for purposes of illustration and description. It is not intended to be exhaustive or to limit the invention to the precise form disclosed, and obviously many modifications and variations are possible in light of the above teaching. The embodiment was chosen and described to best explain the principles of the invention and its practical application. This description will enable others skilled in the art to best utilize the invention in various embodiments and modifications as are suited to the particular use contemplated. It is intended that the scope of the invention be defined by the claims appended hereto.

The embodiments of the invention in which an exclusive property is claimed are defined as follows:

1. A drill rig for drilling in potentially hazardous areas comprising:

a drill rig frame on which a gear motor, gear box, and drive are mounted, a hollow, rotating shaft having an upper end and a lower end, the shaft projecting through the drive and frame; an auger at the lower end of the rotating shaft, the auger having a multiplicity of holes; and, means for supplying and directing an inert gas to the holes in the auger so that inert gas is supplied to the area in which the auger is drilling, thereby preventing a spark from igniting any hazardous gases present in the area.

2. The drill rig of claim 1 in which the means for supplying and directing the inert gas includes a first supply at the upper end of the rotating shaft for supplying gas to the hollow shaft, and a second supply located at the lower end of the shaft for directing the inert gas from the rotating shaft to the holes in the auger.

3. The drill rig of claim 2 in which the second supply includes means for providing a quick disconnect between the hollow shaft and the auger.

* * * * *